United States Patent [19]

Saito

[11] 4,303,997

[45] Dec. 1, 1981

[54] ANALOG ALARM TIMEPIECE

[75] Inventor: Toshiaki Saito, Suwa, Japan

[73] Assignee: Suwa Seikosha Co., Ltd., Suwa, Japan

[21] Appl. No.: 123,844

[22] Filed: Feb. 22, 1980

Related U.S. Application Data

[63] Continuation-in-part of Ser. No. 947,890, Oct. 2, 1978, abandoned.

[30] Foreign Application Priority Data

Oct. 17, 1977 [JP] Japan ..... 52-124265

[51] Int. Cl.[3] ..... G04C 21/16

[52] U.S. Cl. ..... 368/259

[58] Field of Search ..... 368/72-74, 368/250, 251, 255, 259-260; 340/384 E, 388

[56] References Cited

U.S. PATENT DOCUMENTS

| | | | |
|---|---|---|---|
| 3,318,084 | 5/1967 | Patrick | 368/250 |
| 3,681,916 | 8/1972 | Itoyama et al. | 368/250 |
| 3,940,919 | 3/1976 | Yasuda et al. | 368/250 |
| 3,977,177 | 8/1976 | Egger | 368/250 |

*Primary Examiner*—Vit W. Miska

[57] ABSTRACT

Since a button-type battery having the minimum capacity is used for wristwatch, the battery voltage is dropped when power is temporarily consumed. When a step motor consuming much power every second and a buzzer for alarm mechanism operate at the same time, current in quantities flows into these two loads. In result, the battery voltage is dropped and the wristwatch runs down. Therefore, this invention aims to shift the timings of those loads' operations.

8 Claims, 14 Drawing Figures

ANALOG ALARM TIMEPIECE

CROSS-REFERENCE TO RELATED APPLICATION

This application is a continuation-in-part application of our co-pending application, Ser. No. 947,890, filed Oct. 2, 1978, now abandoned.

BACKGROUND OF THE INVENTION

Recently, quartz crystal timepieces have been improved to be provided with many functions, and a liquid crystal digital wristwatch having an alarm mechanism has been realized. The digital alarm wristwatch has an advantage that the alarm is actuated exactly at a predetermined time, occasionally with a few seconds' delay or advance, but it has also a disadvantage that it is complicated to set the alarm. Therefore, a quartz crystal analog alarm timepiece wherein the alarm can be set easily is desired at the present time. However, since the high current flows in a series of pulses every one second to a step motor which is mainly employed as an electromechanical transducer for a quartz crystal analog timepiece, the battery voltage is reduced and the timepiece runs down when the current flowing to the setp motor and the current flowing to a buzzer overlap. In addition, since the quartz crystal analog alarm timepiece is provided with the buzzer besides a coil and a stator of the step motor, a large-sized or thick timepiece is produced. As mentioned above, the conventional quartz crystal analog alarm timepiece has such faults.

SUMMARY OF THE INVENTION

An object of this invention is, in a quartz crystal analog timepiece having a step motor, to prevent the overlap of the electric current for driving the step motor and the electric current for driving a sound generator from reducing the battery voltage greatly by allowing the current for driving the sound generator such as a buzzer or the like to flow in a series of pulses between step motor driving pulses.

Another object of this invention is to provide a miniaturized analog alarm timepiece with the smallest volume for the sound generator by using in common a coil, a coil-core and/or a stator of the step motor and a coil and/or a coil-core for driving the sound generator or by using in common at least one of the coil, the coil-core and the stator of the step motor and a boosting transformer of a piezoelectric buzzer in the case where the supply voltage requires to be boosted since the piezoelectric buzzer is employed as the sound generator.

BRIEF DESCRIPTION OF THE DRAWINGS

For a fuller understanding of the invention, reference is had to the following description taken in connection with the accompanying drawings, in which:

FIG. 10 is a circuit block diagram showing another embodiment to produce a time coincidence signal a.

DESCRIPTION OF THE PREFERRED EMBODIMENTS

Figures 4, 5:
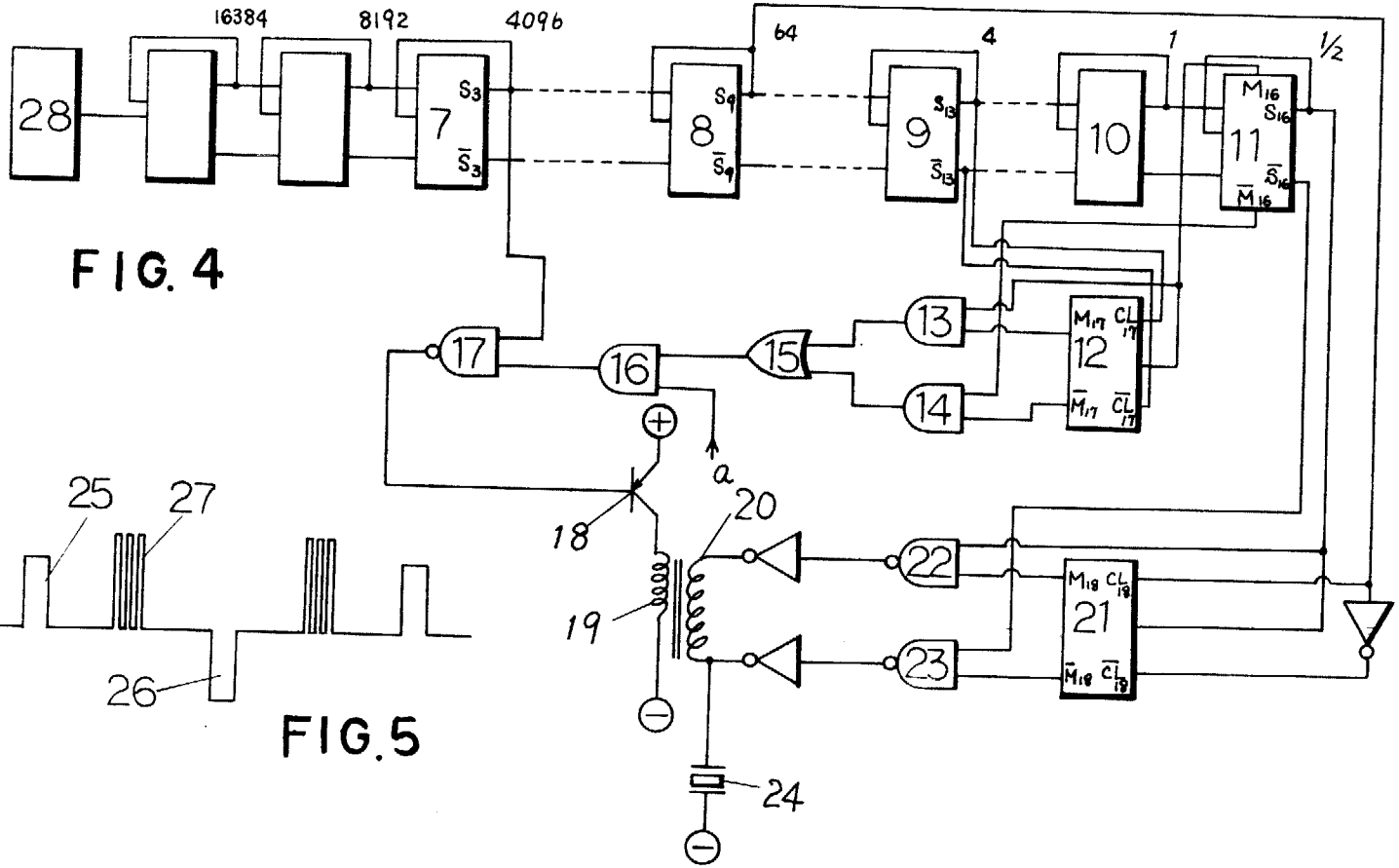
FIG. 4 is a circuit block diagram corresponding to FIG. 3.
FIG. 5 shows the current wave form.
Figure 7:
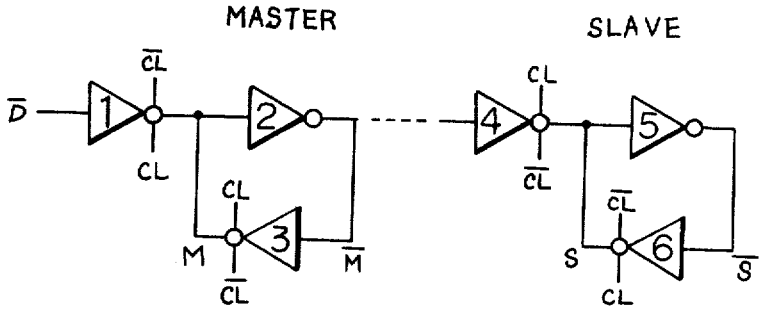
FIG. 7 shows a master slave flip-flop employed in the circuit shown in FIG. 4.

1, 3, 4 and 6 are clocked gate inverters, and 2 and 5 are inverters, in FIG. 7. The clocked gate inverters 1 and 6 are operating when the clock is high, and not operating when the clock is low. The clocked gate inverters 3 and 4 are operating when the clock is low, and not operating when the clock is high. FIG. 4 shows a divider circuit made up of master slave flip-flops, an output circuit, a driving circuit for a sound generator, etc. (A microloud-speaker may be employed as a sound generator, but the buzzer is popularly employed for the timepiece. Therefore hereinafter we refer to the buzzer as the sound generator.) 28 is an oscillator circuit (OSC). 7 to 11 are ½ divider stages, and there are 16 stages in all though middle stages are omitted in this figure. M is an output of master and S is an output of slave. A figure written at the right top of each flip-flop states the frequency of output of the flip-flop. An input a of an AND gate 16 is the input signal for alarm. For example, an hour wheel and an unlocking wheel thereon are provided and they contact with each other at a certain point. The insulated unlocking wheel has a conducting part in a certain limited period.

The input a is usually low, but when the contact point between the hour wheel and the unlocking wheel is turned ON (i.e. when the alarm turns into the state of actuation at a predetermined time), the input a is high. 19 is a boosting coil for the buzzer. 20 is an output coil for a step motor and is also used as a boosting coil for the buzzer. These coils 19 and 20 form a boosting transformer. 24 is a piezoelectric element for the buzzer. Since the driving voltage for the piezoelectric element 24 is usually about 3 V, it can not be driven with 1.5 V of the battery voltage for timepiece, therefore requiring to boost the battery voltage, 1.5 V.

FF (flip-flop) 21 uses an output $S_{16}$ of FF 11 as data and an output $S_9$ (64 Hz) of FF 8 as clock. The output $\overline{S}_{16}$ of FF 11 and an output $\overline{M}_{18}$ of FF 21 are applied to a NAND gate 22, and an output $S_{16}$ of FF 11 and an output $M_{18}$ of FF21 are applied to a NAND gate 23. Outputs of the NAND gates 22 and 23 are applied to the output coil 20 through respective output inverters. In result, inverted pulses 25 and 26 of 7.8 msec. width in FIG. 5, which illustrates the current wave form for driving the step motoı, are produced leaving one second between pulses.

On the other, FF 12 uses an output $M_{16}$ of FF 11 as data and outputs $S_{13}$ and $\overline{S}_{13}$ of FF 9 as clock. An output $M_{17}$ of FF 12 has a delay of 125 msec., a half clock of 4 Hz, as compared with the output $M_{16}$. The outputs $M_{16}$ and $M_{17}$ are applied to an AND gate 13, and outputs $\overline{M}_{16}$ and $\overline{M}_{17}$ are applied to an AND gate 14. Outputs of the AND gates 13 and 14 are applied to an OR gate 14. Pulses of 125 msec. width are produced from the OR gate 15 leaving one second between pulses. The wave form thereof is a half second out of phase with the step motor driving current wave form shown in FIG. 5. At this time, the contact between the hour wheel and the unlocking wheel is turned ON, and the signal a becomes high. Then an AND gate 16 being tuned open, the output signal of the OR gate 15 and an output of 4096 Hz of FF 7 are combined by a NAND gate 17. An output of the NAND gate 17 is amplified by a transistor 18 for driving the buzzer and boosted by the boosting transformer comprising coils 19 and 20. Then the piezoelectic element 24 is driven. Consequently, the buzzer driving pulse 27 is located in the middle between step motor driving pulses 25 and 26 as illustrated in FIG. 5.

Figure 1:
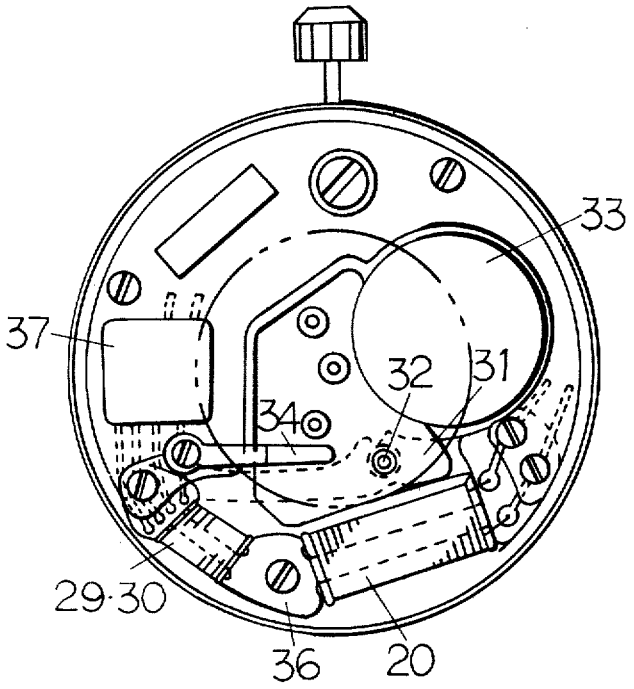
FIGS. 1 and 2 are respectively a plan view and a sectional view of an embodiment according to this invention.
Figure 6:
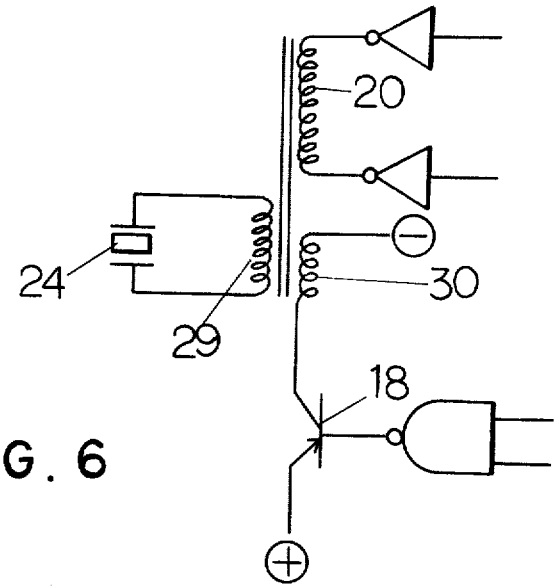
FIG. 6 is a circuit block diagram of a coil portion of the embodiment shown in FIG. 1.

FIG. 6 is a circuit block diagram of a coil portion of another embodiment shown in FIG. 1, wherein a boosting transformer comprising coils 29 and 30 is provided separately from the step motor driving coil 20. Since the boosting transformer is provided independently, the buzzer can be driven efficiently. Also in this case, since a coil-core (including a stator) is used in common, the timepiece can be miniaturized.

Figure 2:
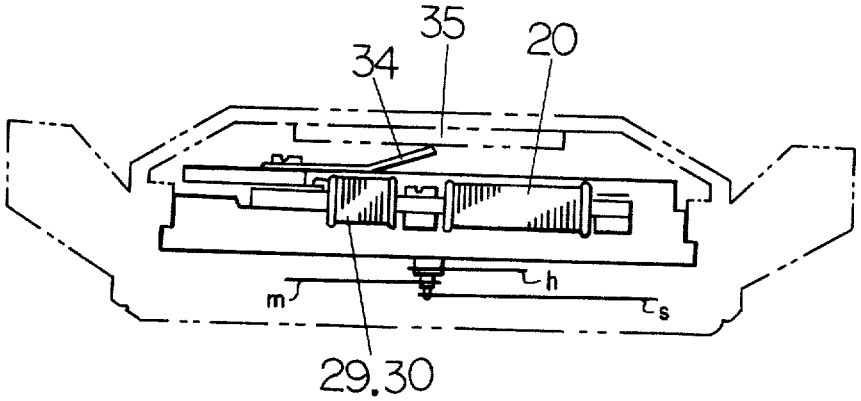

FIGS. 1 and 2 correspond to FIG. 6. 20 is the step motor driving coil. 36 is a coil-core. 29 and 30 are coils for the boosting transformer. 31 is a stator. 32 is a rotor. 33 is a battery. 34 is a contact portion to contact an piezoelectric element 35 with a circuit 37. Since the coil-core is used in common, the quartz crystal analog timepiece can be provided with the buzzer mechanism in a small space. In FIG. 2, h, m, and s are respectively an hour hand, a minute hand and a seconds hand. These hands rotate above the upper surface of a dial and conduct analog display. Even if the buzzer driving current is supplied to the coils 29 and 30 for the boosting transformer, the rotation of the rotor 32 is not caused due to the fact that the width of the buzzer driving pulse is narrow, that is 125 msec. as mentioned above. The pulse width of the buzzer driving current may take any value if the pulse of such a value never cause the rotation of the rotor.

Figure 3:
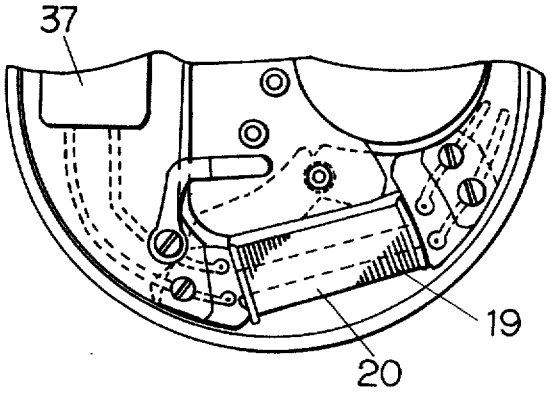
FIG. 3 is a plan view showing another embodiment.

FIG. 3 shows another embodiment, wherein the step motor driving coil is used to form the boosting transformer by taking a tap out of the step motor driving coil or winding two coils. Accordingly the existing quartz crystal analog timepiece can be easily changed into an alarm timepiece.

Figure 14:
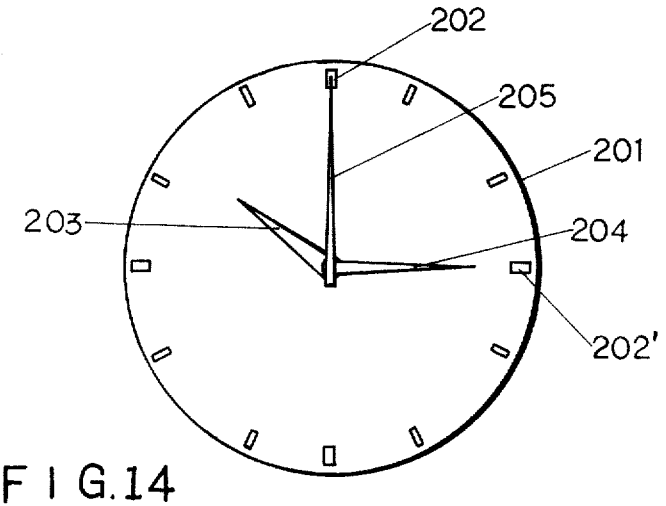
FIG. 14 is a plan view of an analog display couducted by a dial and hands.

This invention is not limited to the above embodiments. There is another ways; not only step motor driving pulse for one second hand movement but also step motor driving pulse for five second or one minute hand movement may be efficient. Generally, when it is zero second, the seconds hand must stop at the dialling of 12 or the minute hand must stop coinciding with a minute dialling, as concretely shown in FIG. 14. 201 is a dial. 202 is hour and/or minute diallings. The minute diallings may be laid every minute. 203 is an hour hand. 204 is a minute hand. 205 is a seconds hand. The seconds hand must stop exactly at the dialling 202 and the minute hand also must stop exactly at the dialling 202'. Therefore, the timepiece must be moved by driving pulses of N/60 Hz (N=1~60). Besides the buzzer driving pulse may be located anywhere between step motor driving pulses without any overlap of the step motor driving pulse and the buzzer driving pulse.

Figure 8:
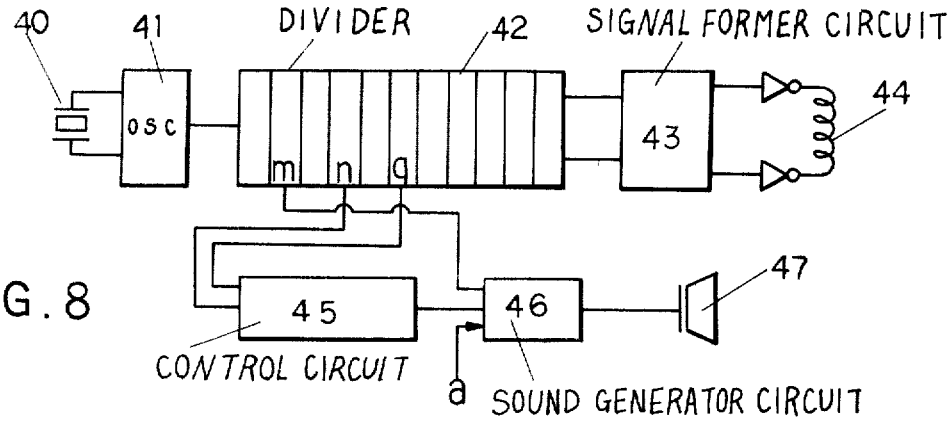
FIG. 8 is a block diagram of an analog alarm timepiece in accordance with this invention.

FIG. 8 is a block diagram of the analog alarm timepiece in accordance with this invention. A step motor is driven by pulses of N/60 Hz (N=1~60). A signal of a quartz crystal oscillator 40 oscillating with high frequency are fed to a divider 42 through an oscillator circuit 41. The divider 42 comprises a plurality of divider stages, and produces required output frequency N/60 Hz by combination of well-known ½ divider stages, ⅓ divider stages and 1/5 divider stages. The output is connected to a signal former circuit 43. In an analog timepiece such that a mechanical gear train is driven by a step motor, there is no necessity for feeding current to a coil 44 of the step motor at ordinary times. The current feeding is only required for a short time enough to rotate a rotor of the step motor by one step. Generally, the short time is 7 to 30 msec. Therefore, the signal former circuit 43 forms the signal of N/60 Hz supplied from the divider into an intermittent pulse signal of 7 to 30 msec. pulse width, and feeds the intermittent pulse signal to the coil of the step motor to intermittently drive the motor. An embodiment of the signal former circuit 43 comprises the master slave flip-flop 21 and the NAND circuits 22 and 23, as shown in FIG. 4. A sound generator mechanism comprises a control circuit 45 to determine the proper alarm duration and the proper actuation period by using signals from the divider, a sound generator circuit 46 for producing driving pulses of relatively high frequency to actuate a buzzer and a buzzer 47. The phase and period of the control circuit 45 are shifted so as not to deliver step motor driving pulses and buzzer driving pulses at the same time. An embodiment of the control circuit 45 comprises the master slave flip-flop 12, AND circuits 13 and 14, and OR circuit 15, as shown in FIG. 4. An embodiment of the sound generator circuit 46 comprises NAND circuit 17 using a frequency from the divider.

Figure 9:
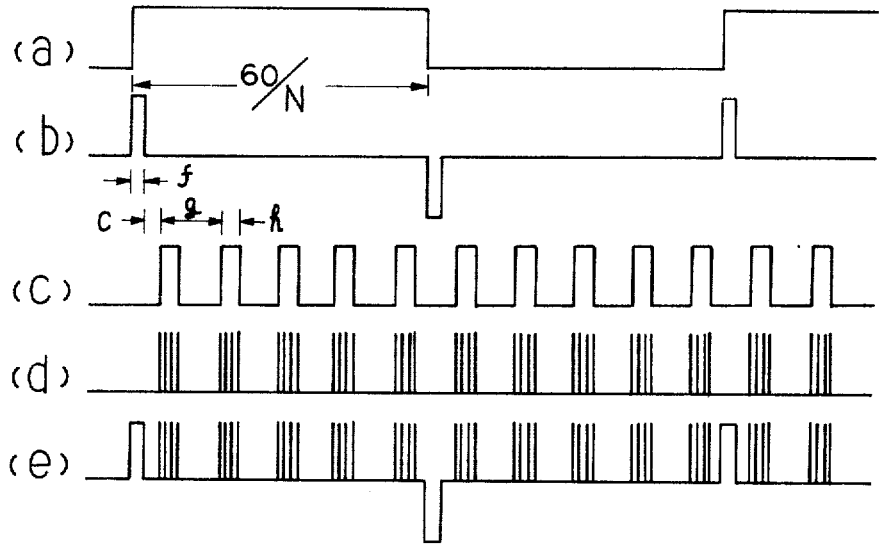
FIG. 9 is a timing chart showing the operation of the sound generator mechanism.

The operation of the sound generator mechanism is described referring to a timing chart FIG. 9 and a block diagram FIG. 8. An output signal (a) supplied from the divider is formed into an intermittent signal (b) of N/60 Hz by the signal former circuit 43, and the intermittent signal (b) drives the step motor intermittently with a period of 60/N second. The control circuit 45 receives a signal to determine an actuation period g and a phase difference i of the buzzer from a proper divider stage q and a signal to determine one alarm duration h from a proper divider stage n, and delivers a signal (c). The sound generator circuit 46 receives a frequency desirable to actuate the buzzer 47 from a proper divider stage m. Receiving the frequency from the divider stage m and the signal (c) from the control circuit 45, the sound generator circuit 46 delivers a sound generating signal (d) by the function of logical AND thereof. The sound generator circuit is actuated only when the circuit receives a time coincidence signal a from the time keeping mechanism. This structure is the same as that of FIG. 4. (e) shows the step motor driving pulses (b) and the buzzer driving pulses (d) which are arranged in a row for convenience' sake. As seen from the chart (e), the step motor driving pulse (b) are completely out of phase with the busser driving pulse (d). Accordingly, troubles such as the decrease in current while the buzzer is driven, the abnormal operation of the step motor due to the effect of magnetism, etc. are all dissolved.

Thus, the analog alarm quartz crystal timepiece in accordance with this invention has the first circuit means comprising the signal former circuit connected with the divider and the drive circuit for the step motor and the second circuit means comprising the control circuit connected with divider to produce the buzzer driving signal and the sound generator circuit, and the control circuit has a function to make the intermittent pulse signal for driving the step motor out of phase with the intermittent pulse signal for driving the buzzer. This is a great feature of this invention. In order to surely make the step motor driving pulse (b) out of phase with the buzzer driving pulse (d), it is necessary that the synchronism of one driving pulse is integral multiples of the synchronism of the other driving pulse and further that the phase difference is wider than at least the pulse width f of the step motor driving pulse (b). Therefore, desired divider stages to meet these requirements must be selected.

For example, in the case where the frequency of the quartz crystal vibrator is 32768 Hz and the timepiece is driven each 20 seconds by one pulse, a signal of ½ Hz is obtained by using sixteen ½ divider stages sequentially connected, as shown in FIG. 4. In addition two ½ divider stages and one 1/5 divider stage are sequentially connected and thereby a signal of 1/40 Hz is obtained. Since the divider alternately feeds two signals of 180 degrees out-of-phase to the signal former circuit to drive the step motor, the step motor is practically driven by a signal of 1/20 Hz. The drive signal is formed into an intermittent signal of about 8 msec. pulse width by the signal former circuit. Generally, the buzzer 47 connected with the sound generator circuit is actuated with a period of 1 second or 2 seconds. In the case of the actuation with a period of 1 second, the pulse difference i between the step motor driving signal and the buzzer driving signal is determined to 0.5 second and the actuation period g is determined to 1 second by gaining a data signal of ½ Hz from the master of the sixteenth stage in the divider made up of master slave flip-flops as shown in FIG. 4. Thereby the step motor driving pulse and the buzzer driving pulse are not delivered at the same time. Further, one alarm duration h is determined to 125 msec. by using an output of 4 Hz from the thirteenth stage of the divider, and the musical interval of the buzzer sound is determined by using a signal of 4096 Hz from the third stage of the divider. In the case of the actuation with a period of 2 seconds, the pulse difference i is determined to 1 second and the actuation period g is determined to 2 seconds by using a signal of ¼ Hz from the seventeenth stage of the divider. The alarm duration and the musical interval are determined in the same manner as the actuation with a period of 1 second, that is by using the output of 4 Hz from the thirteenth stage of the divider and the signal of 4096 Hz from the third stage of the divider.

In FIG. 1, the time coincidence signal a is obtained by utilizing the contact point of the unlocking wheel. However, since such a mechanical contact is rough to detect the coincidence with the predetermined alarm time, advance or delay of about 1 minute is caused. This is not suitable for the quartz crystal timepiece of high accuracy. Therefore, it is considered to electrically obtain the time coincidence signal in order to eliminate the above fault.

Figure 10:
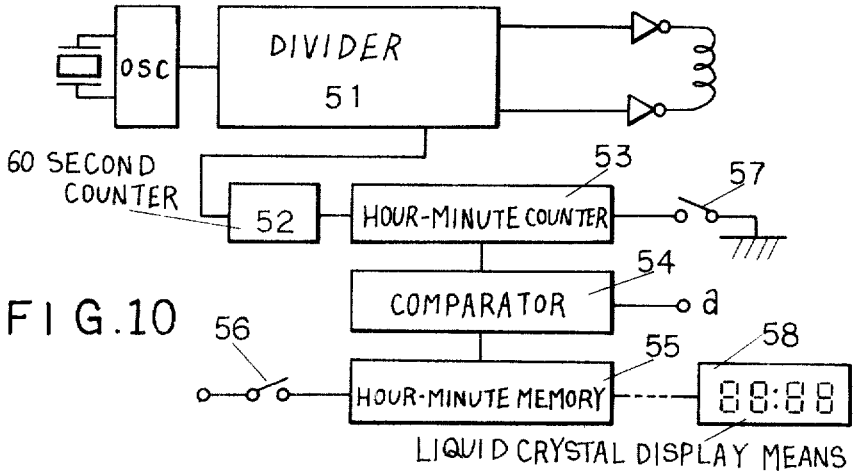

FIG. 10 is a circuit block diagram showing another embodiment to produce a time coincidence signal a. In FIG. 10, 51 is a divider. Output therefrom drives a step motor. 53 is an hour-minute counter receiving a signal from a 60 second counter 52 and counts hours and minutes in response to the signal from the divider. The hour-minute counter 53 has a reset switch 57. When all hands of the analog timepiece indicate the dialling of 12, the reset switch is actuated and the hour-minute counter corresponds to the position of the hands. 55 is an hour-minute memory made up of counters, and the digits (hour digit and minute digit) thereof correspond to the digits of the hour-minute counter. The hour-minute memory 55 has a switch 56 for setting the hour-minute memory from the external. A desired alarm time is stored in the hour-minute memory by an input from the switch 56. 54 is a comparator and always compares the hour-minute counter 53 with the counted contents of the hour-minute memory 55. When the counted contents of the memory coincide with the counter, the time coincidence signal a is delivered. Thus, the buzzer is extremely punctually actuated at the accurate alarm time. It is effective to provide on a dial or a watch case a liquid crystal display means 58 conducting a digital display corresponding to a time which is stored in the hour-minute memory in order to set the hour-minute memory. This invention is applied to the three hand timepiece (which has an hour hand, a minute hand and a seconds hand) and also the two hand timepiece (which has an hour hand and a minute hand). Not only piezoelectric buzzer but also electromagnetic buzzer is used in this invention.

In FIGS. 1 to 8, the buzzer intermittently emits the sound at the same time that the time coicidence signal a is applied. Another various manners to actuate the buzzer are found. For example, the buzzer emits the sound once at every o'clock (1 o'clock, 2 o'clock, 3 o'clock, 4 o'clock, -----). Such a manner for alarm is useful and is easily realized by a structure shown in FIG. 11.

Figure 11:
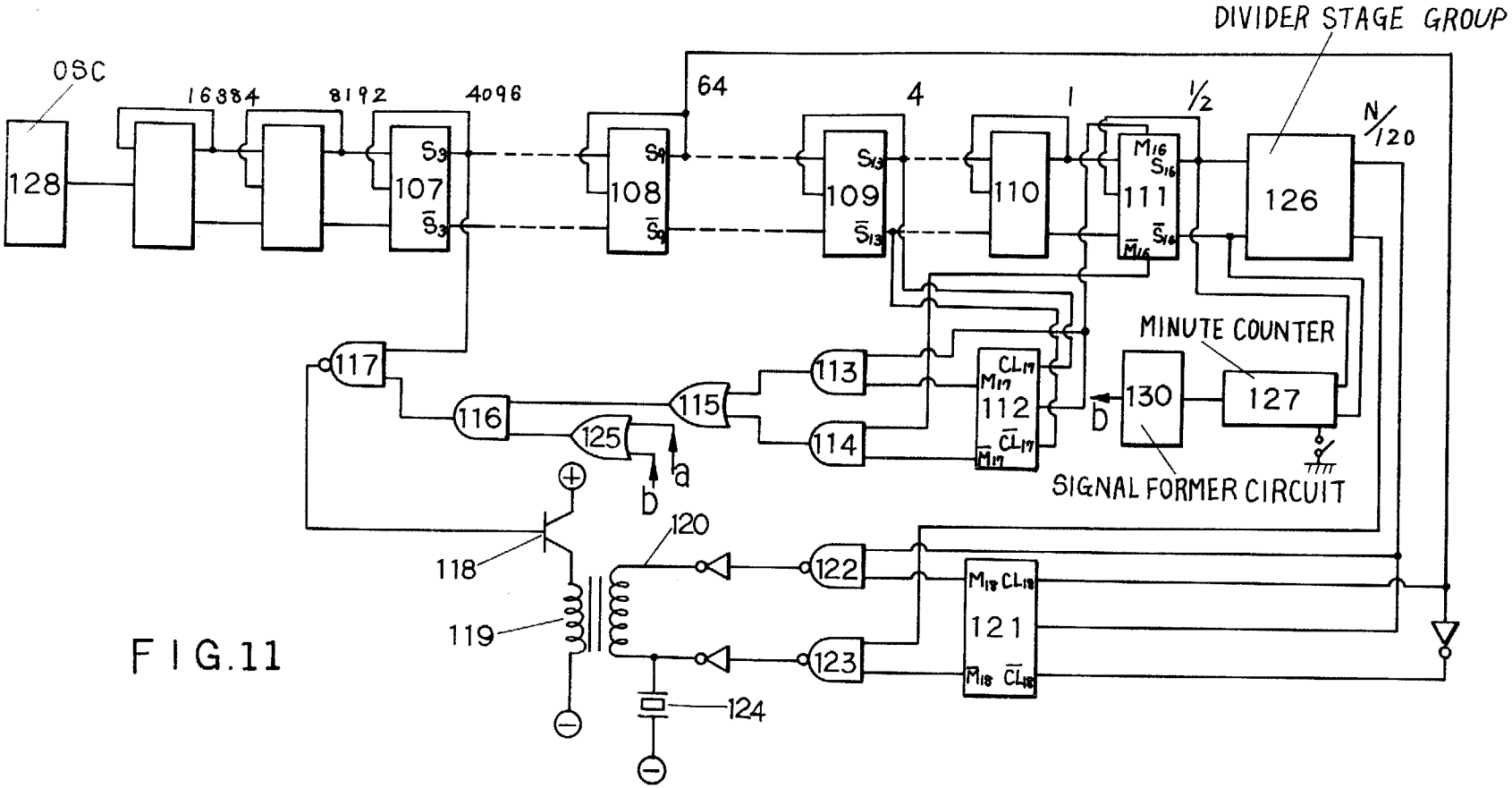
FIG. 11 shows another embodiment to emit the sound at every o'clock.

In FIG. 11, means and arrangements of reference numerals 107 to 124 and 128 are identical with the means and arrangements of reference numerals 7 to 24 and 28 in FIG. 4. FIG. 11 shows a divider circuit made up of master slave flip-flops, an output circuit, a buzzer driving circuit, etc. 107 to 111 are ½ divider stages and divide a signal from the oscillator circuit 128 into signals of low frequencies. 112 is a flip-flop and delays a signal from $M_{16}$ by a value determined by a signal of 4 Hz applied in $CL_{17}$. 113 and 114 are AND gates and determine an actuation period and an alarm duration of a buzzer. 115 is NOR gate. Signals from AND gates 113 and 114 are synthesized thereby and connected to AND gate 116. AND gate 116 receives the time coincidence signal a or a time indicating sound signal b as mentioned later and the output of NOR gate 115, and produces a signal by the function of logical AND thereof. 117 is NAND gate and receives an output of 4096 Hz from the third stage of the divider to determine the musical interval of the buzzer sound and a signal from AND gate 116. NAND gate 117 produces a signal by the function of logical NAND thereof and feeds the signal to a boosting transformer 119 through a transistor 118. In such a buzzer, one alarm duration in 125 msec. and the sound is successively emitted with a period of 1 second. The buzzer driving pulse is 0.5 second out of phase with the step motor driving pulse. 126 is a divider stage group including ½ divider stages, ⅓ divider stages and/or 1/5 divider stages combined optionally, and drives the step motor with a period of 1 second or more. Since a seconds hand and/or a minute hand must stop at the dialling of 12 and/or each minute dialling, a period of 60/N second (N=1~60) is required. Therefore, an output from the last divider stage of the divider is N/120 Hz (N=1~60). 121 is a flip-flop and makes up a signal former circuit with AND gates 122 and 123. 120 is a step motor driving coil and is also used as a secondary coil for boosting. 124 is a piezoelectric buzzer. 127 is a minute counter. The minute counter 127 counts outputs from $S_{16}$ and $\overline{S}_{16}$ of the divider and feeds a signal to a signal former circuit 130 once per 60 minutes. The minute counter has a reset switch 131, which is actuated at every o'clock (1 o'clock, 2 o'clock, 3 o'clock -----) when time correction is required. Thereby the counter corresponds with the position of hands, and the signal from the minute counter 127 is used as a time indicating signal. The signal former circuit 130 delivers a signal in response to the output of the minute counter 127, which is out of phase with the step-motor driving signal so as not to be delivered at the same time that the step motor driving pulse is delivered. The output b of the signal former circuit 130 is connected to an OR gate 125 and drives the buzzer.

Figure 12:
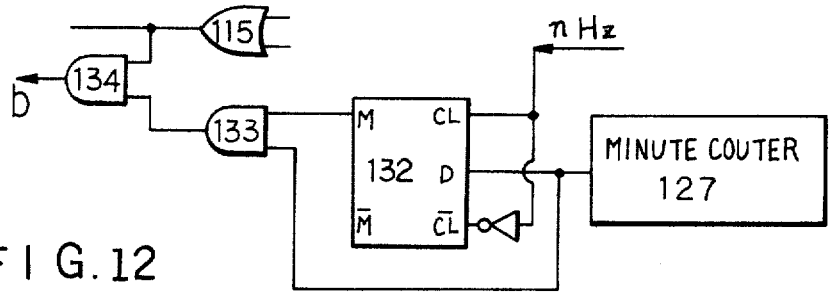
FIG. 12 shows an embodiment of the signal former circuit in accordance with this invention.
Figure 13:
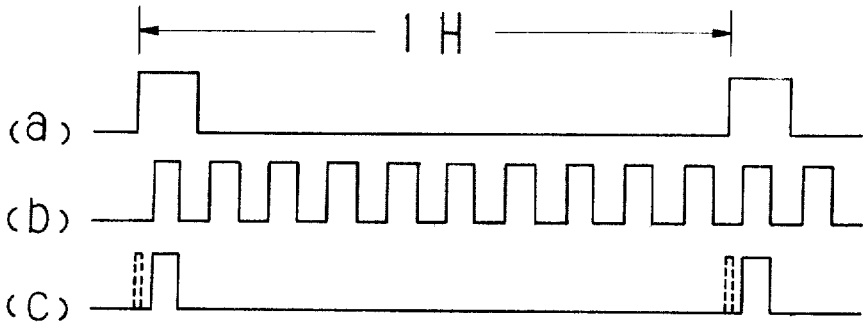
FIG. 13 is a timing chart of the embodiment shown in FIG. 11.

FIG. 12 shows an embodiment of the signal former circuit in accordance with this invention. The minute counter 127 delivers a signal with a period of 1 hour, and the signal is used as data for a flip-flop (FF) 132. The signal to determine an actuation period of the buzzer which emits the sound at the predetermined alarm time as described in FIG. 4 is applied to CL of FF 132 from the divider. In FIG. 12, the signal is represented as n Hz. For example, in the case of the actuation period of 1 second, a signal from the divider stage which delivers the signal of ½ Hz is used in the same manner as FIG. 4. An output M of FF 132 is delivered with delay of half clock of ½ Hz, that is 1 second and connected with an output signal from the signal former circuit 127 in AND gate 133, then a signal of 1 second pulse width delivered once an hour is obtained. FIG. 13 (*a*) shows such a signal. This signal is connected with a signal from OR gate 115 (FIG. 13 (*b*)) which are used for the ordinary actuation of the buzzer shown in FIG. 11 in AND gate 134, thereby the time indicating sound signal delivered once an hour and the step motor driving pulse are delivered with some phase difference, as shown in FIG. 13 (*c*). A broken line presents the step motor driving pulse.

In addition, though coils 29 and 30 are wound round the coil-core in FIG. 1, they may be wound round the stator 31.

If the width of pulses for driving the buzzer is more narrowed, it is possible to employ a battery including NaOH electrolyte, therefore this is more desirable with respect to the leakage of electrolyte and the self-discharge.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a miniaturized analog quartz crystal timepiece having a quartz crystal vibrator as a time standard, a step motor for driving a display mechanism of timepiece and an electric sound generator, the improvement comprising:

a battery for driving said step motor and said sound generator;

a divider made up of a plurality of divider stages to divide frequency of said quartz crystal vibrator into low frequency for timepiece;

first circuit means connected with said divider to produce an intermittent signal for driving said step motor; and second circuit means connected with said divider to produce an intermittent signal for driving said sound generator;

whereby said intermittent signal for driving said sound generator supplied from said second circuit means is out of phase with said intermittent signal for driving said step motor supplied form said first circuit means, and the phase difference is wider than pulse width of said intermittent signal for driving said step motor.

2. A miniaturized analog quartz crystal timepiece as claimed in claim 1, and further including a transformer for driving said sound generator, said transformer comprising first coil connected with said second circuit means to produce said intermittent signal for driving said sound generator and second coil connected to said sound generator, said second coil being formed of a driving coil of said step motor, and said first coil being wound on the same coil-core as said second coil so as to be put on top of said second coil.

3. A miniaturized analog quartz crystal timepiece as claimed in claim 1, and further including a transformer for driving said sound generator, said transformer comprising first coil connected with said second circuit means to produce said intermittent signal for driving said sound generator and second coil connected to said sound generator, said second coil being formed of a driving coil of said step motor, and said first coil being wound on the extension of a coil-core of said driving coil of said step motor.

4. A miniaturized analog quartz crystal timepiece as claimed in claim 1, wherein said intermittent signal for driving said step motor has frequency of N/60 Hz, N representing a value from 1 through 60.

5. A miniaturized analog quartz crystal timepiece as claimed in claim 1, wherein said second circuit means to produce said intermittent signal for driving said sound generator has a switch means actuated by an input from an coincidence detecting mechanism of timepiece.

6. A miniaturized analog quartz crystal timepiece as claimed in claim 5, wherein said coincidence detecting mechanism of timepiece is electronic.

7. A miniaturized analog quartz crystal timepiece as claimed in claim 1, wherein master slave flip-flops are used for said divider, said first circuit means to produce said intermittent signal for driving said step motor and said second circuit means to produce said intermittent signal for driving said sound generator.

8. A miniaturized analog quartz crystal timepiece as claimed in claim 1, wherein said second circuit means has means to count one hour and means to deliver one time indicating sound signal according to a signal supplied from said means.

* * * * *